US006698042B2

(12) United States Patent
Cheng

(10) Patent No.: US 6,698,042 B2
(45) Date of Patent: Mar. 2, 2004

(54) BASE OF A FOLDABLE BABY BED

(75) Inventor: Ying-Hsiung Cheng, Tainan Hsien (TW)

(73) Assignee: Pao-Hsien Cheng, Tainan Hsien (TW)

( * ) Notice: Subject to any disclaimer, the term of this patent is extended or adjusted under 35 U.S.C. 154(b) by 0 days.

(21) Appl. No.: 09/859,382

(22) Filed: May 18, 2001

(65) Prior Publication Data

US 2002/0170111 A1 Nov. 21, 2002

(51) Int. Cl.[7] ..... A47D 7/00
(52) U.S. Cl. ..... 5/99.1; 16/324; 16/326
(58) Field of Search ..... 5/99.1; 16/324, 16/326

(56) References Cited

U.S. PATENT DOCUMENTS 5,699,997 A * 12/1997 Huang ..... 16/343
5,819,342 A * 10/1998 Williams ..... 5/99.1
6,170,099 B1 * 1/2001 Cheng ..... 5/99.1
6,305,037 B1 * 10/2001 Cheng ..... 5/99.1
6,349,434 B1 * 2/2002 Zhuang ..... 5/99.1
6,421,850 B1 * 7/2002 Welsh, Jr. ..... 5/99.1

* cited by examiner

*Primary Examiner*—David Bagnell
*Assistant Examiner*—Sunil Singh
(74) *Attorney, Agent, or Firm*—Rosenberg, Klein & Lee

(57) ABSTRACT

A base of a foldable baby bed has two axles each trunally passed through a pair of receiving holes of a main body. The axles are each pivoted to two connecting rods form two ends; the connecting rods are pivoted to the frame of the bed. The main body has a controlling handle with two end cam parts being fitted onto hollows on two sides of the main body. A pivotal bolt is passed through the cam parts, through hole on the hollows, connected to a connecting bolt up-and down movably passed through a receiving room on a top portion of the main body. The through holes have elongated opening for the pivotal bolt, and the connecting bolt to move up and down by pivoting the handle on the pivotal bolt. The connecting bolt is connected to an engaging board movably received in the main body. The engaging board has engaging holes on two end portions for separably engaging rod-shaped engaging parts sticking out from the middle of the corresponding axles. Thus, the engaging board can be easily moved up to lock the axles to fix the connecting rods in a stretched position with the controlling handle, and moved down for the axles to turn in order to fold the baby bed.

6 Claims, 15 Drawing Sheets

BASE OF A FOLDABLE BABY BED

BACKGROUND OF THE INVENTION

The present invention relates to a base of a foldable baby bed, and particularly to one, which has relatively smooth pivotal movement to be not easily damaged under frequent pivotal movement of the parts for folding and stretching of the baby bed, and is compact for permitting the baby bed to be folded to a desired small size.

Referring to FIGS. 14 and 15, a conventional base for a foldable baby bed includes a middle member 10, a first pivotal rod 20, a second pivotal rod 30 and two turning members 60.

The middle member 10 has an elongated shape, and has holed connecting protrusion sets 105 at two ends, and holed connecting protrusion sets 103 at intermediate portions. Receiving hollows 101 are formed between the central support rod (not numbered) and each of the connecting protrusion sets 103, each having a spring 102 disposed therein.

The first pivotal rod 20 is pivoted to one of the connecting protrusion sets 103 with a locating block 201 being connected to a lower end of the corresponding spring 102; a curved recess 203 is formed at an outer end; a corresponding wall 107 in the gap 106 between two connecting protrusions of one of the sets 105, and the curved recess 203 are arranged abreast.

The second pivotal rod 30 is pivoted to the other connecting protrusion set 103 with a locating block 301 being connected to a lower end of the corresponding spring 102. And, an outer end curved recess 302, and the corresponding wall 107 in a gap between the connecting protrusions of the other set 105 are arranged abreast.

Thus, the springs 102 bias the curved recesses 203, and 302 of the pivotal rods 20 and 30 upwards to connect the walls 107 of the middle member 10. The first pivotal rod 20 is pivoted to an inner end portion of the second pivotal rod 30 from the inner end portion, and is connected to a belt 40 passed through an elongated hole 104 of the middle member 10 such that the pivotal rods 20 and 30 can be pivoted for moving the outer end curved recesses 203 and 302 away from the walls 107 by pulling the belt 40.

The turning members 60 each has a rod part (not numbered) turnably passed through the corresponding connecting protrusion set 105; the rod parts each has a stopping element 601 projecting out from a lower side of the middle part.

Thus, when the outer end curved recesses 203 and 302 are moved away from the walls 107 of the middle member 10 by pulling the belt 40, the stopping elements 601 of the turning members 60 are no long stopped from moving by the curved recesses 203 and 302. Therefore, the rod parts of the turning members 60 can be turned in the connecting protrusions 105 for the connecting rods 50 connected to two ends of the turning members 60 to pivot inwardly of the baby bed for folding of the baby bed.

However, the connecting base for a foldable baby bed is found to have drawbacks as follows:

1. The baby bed still can't be folded into a satisfactorily small size because the middle member of the base, which decides the size of the baby bed after folding, has relatively big transverse cross section area, and is relatively long.
2. The pivotal rods 20 and 30 with pivotal connection of the kind get damaged very easily under frequent pivotal movement for folding and stretching of the baby bed.

SUMMARY OF THE INVENTION

Therefore, it is a main object of the present invention to provide a base for a foldable baby bed, which can't be easily damaged by frequent movement of the parts in folding and stretching the baby bed, and which is compact for permitting the baby bed to be folded into a satisfactorily small size.

The base of a foldable baby bed of the present invention has a main body, two axles, four connecting members and a controlling handle.

The main body has a receiving room with a tube-shaped element up and down movably received therein. The main body receives a movable engaging board in it with a connecting bolt passed through the engaging board; the engaging bolt is connected to the tube-shaped element from an upper end, and passed through an upper spring disposed between a lower end of the receiving room, and an upper side of the engaging board. The connecting bolt is further passed through a lower spring disposed between the board and a nut connected to a lower end of the bolt for permitting the board to move together with the tube-shaped element.

The axles are each turnably passed through a pair of through receiving holes of the main body, and each has a rod-shaped engaging part having two end portions sticking out from a middle part of the axle. The main body has intermediate gaps between the through receiving holes for the rod-shaped engaging parts to be movably received therein.

The connecting members are connected to a respective one of end portions of the axles sticking out from the through receiving holes. The connecting members each has a connecting room pivotally connected to a corresponding one of the connecting rods pivoted to the frame of the bed.

The controlling handle has two holed cam parts at two ends, and is pivotally connected to the main body by means of a pivotal rod passed through the cam parts, a through hole of the main body, and the tube-shaped element; the cam parts are fitted onto a respective one of hollows on two sides of the main body; the through hole for the pivotal rod has an elongated opening for permitting the handle to be pivoted on the pivotal rod to move the engaging board up and down together with the pivotal rod and the tube-shaped element.

The engaging board is moved down by means of pivoting the handle to an unlocking position, for engaging holes on two end portions of the board to separate from the corresponding sticking-out end portions of the middle rod-shaped engaging part of the axles for permitting the axles to turn in the through receiving holes to pivot the connecting rods to fold the baby bed. The engaging board is moved up to lock the rod-shaped engaging parts of the axles from the engaging holes to fix the connecting rods at a stretched position.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
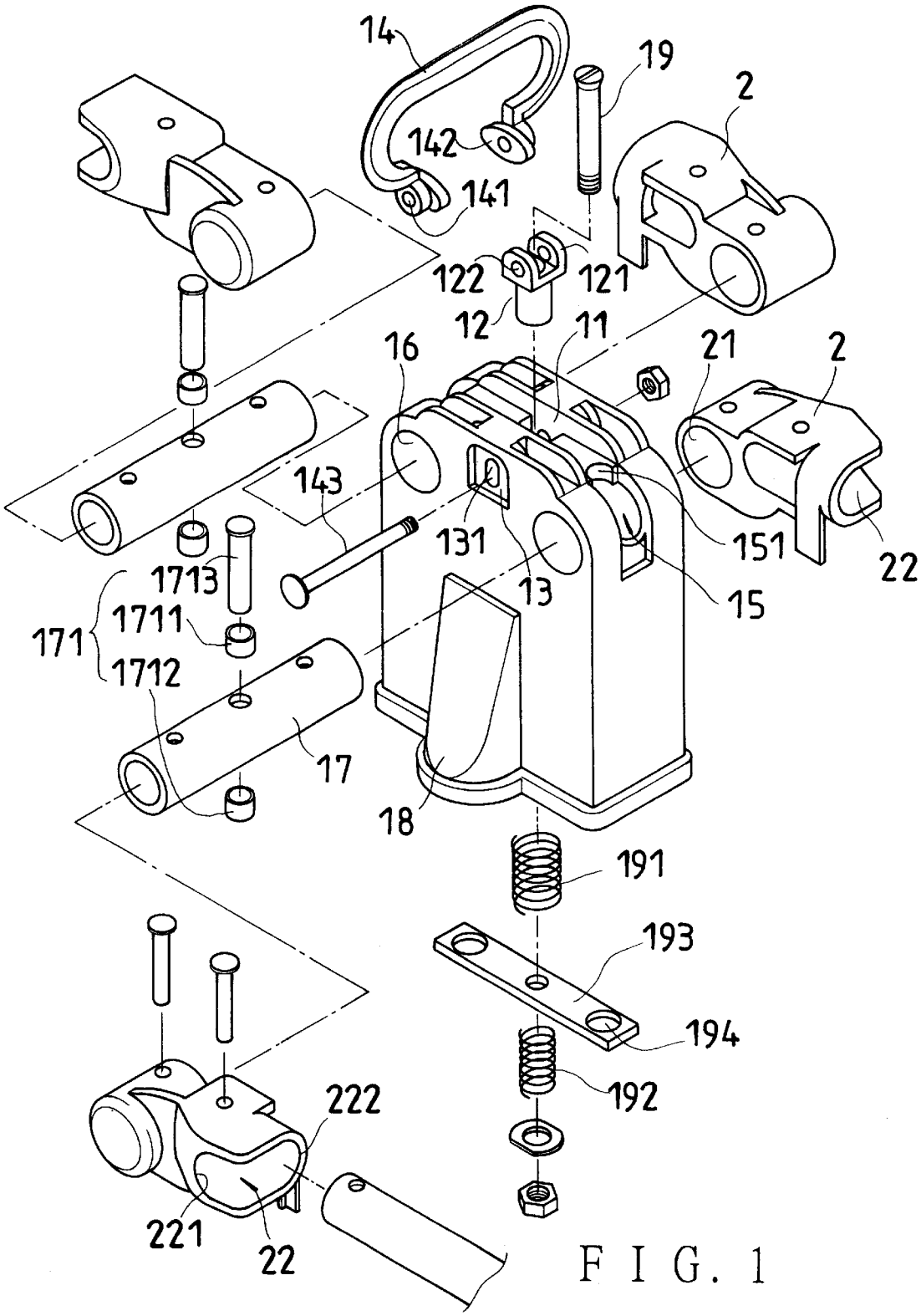
FIG. 1 is an exploded perspective view of the base of a foldable baby bed according to the present invention.
Figure 2:
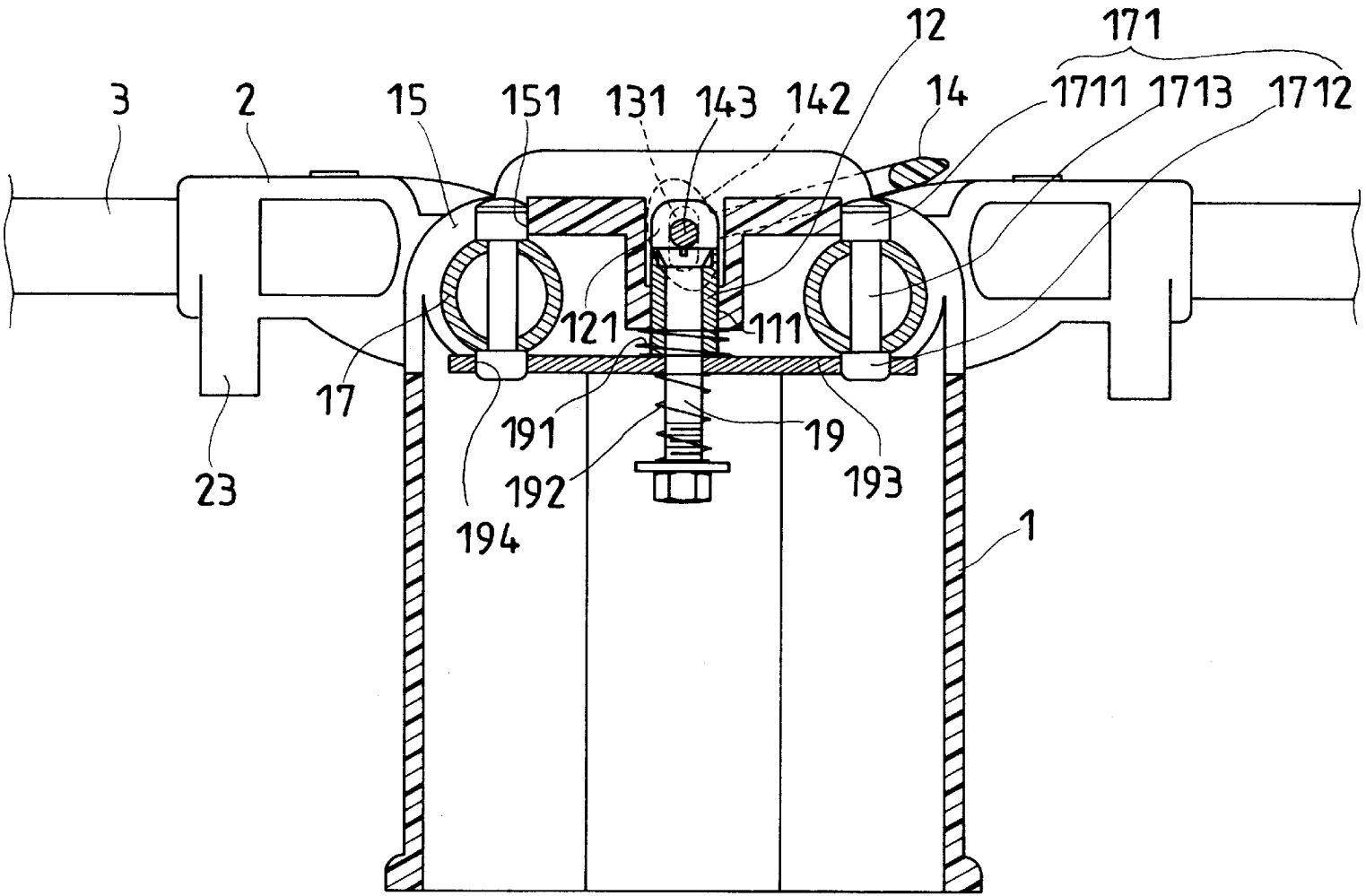
FIG. 2 is a cross-sectional view of the base of a foldable baby bed according to the present invention.
Figure 3:
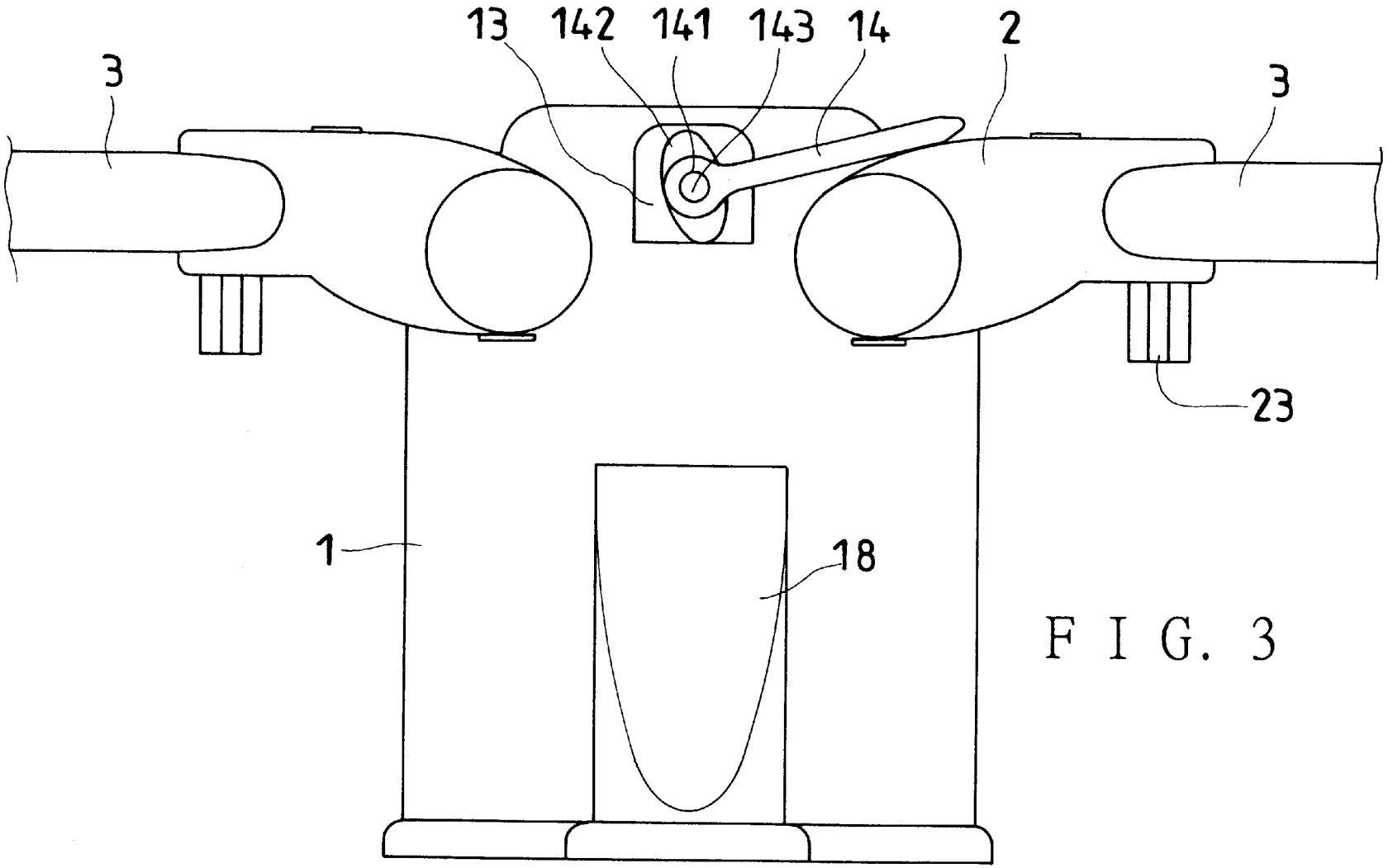
FIG. 3 is a front view of the base of the present invention.

Referring to FIGS. 1, 2, 3 and 4, a base of a foldable baby bed according to the present invention includes a main body 1, two axles 17, four connecting members 2, a controlling handle 14 and four connecting rods 3 (FIG. 3).

The main body 1 has two through receiving hole sets 16 on a front end and a rear end of an upper portion respectively; the through receiving hole sets 16 each has two receiving holes, which have an intermediate gap 15 sandwiched in between. The intermediate gaps 15 each has a curved wall 151 on the upper end of the main body 1. The main body 1 further has a central receiving room 11 defined by a wall; a tube-shaped element 12 is movably received in the central receiving room 11, and has holed connecting protrusions 121 sticking out from the upper end.

Figure 6:
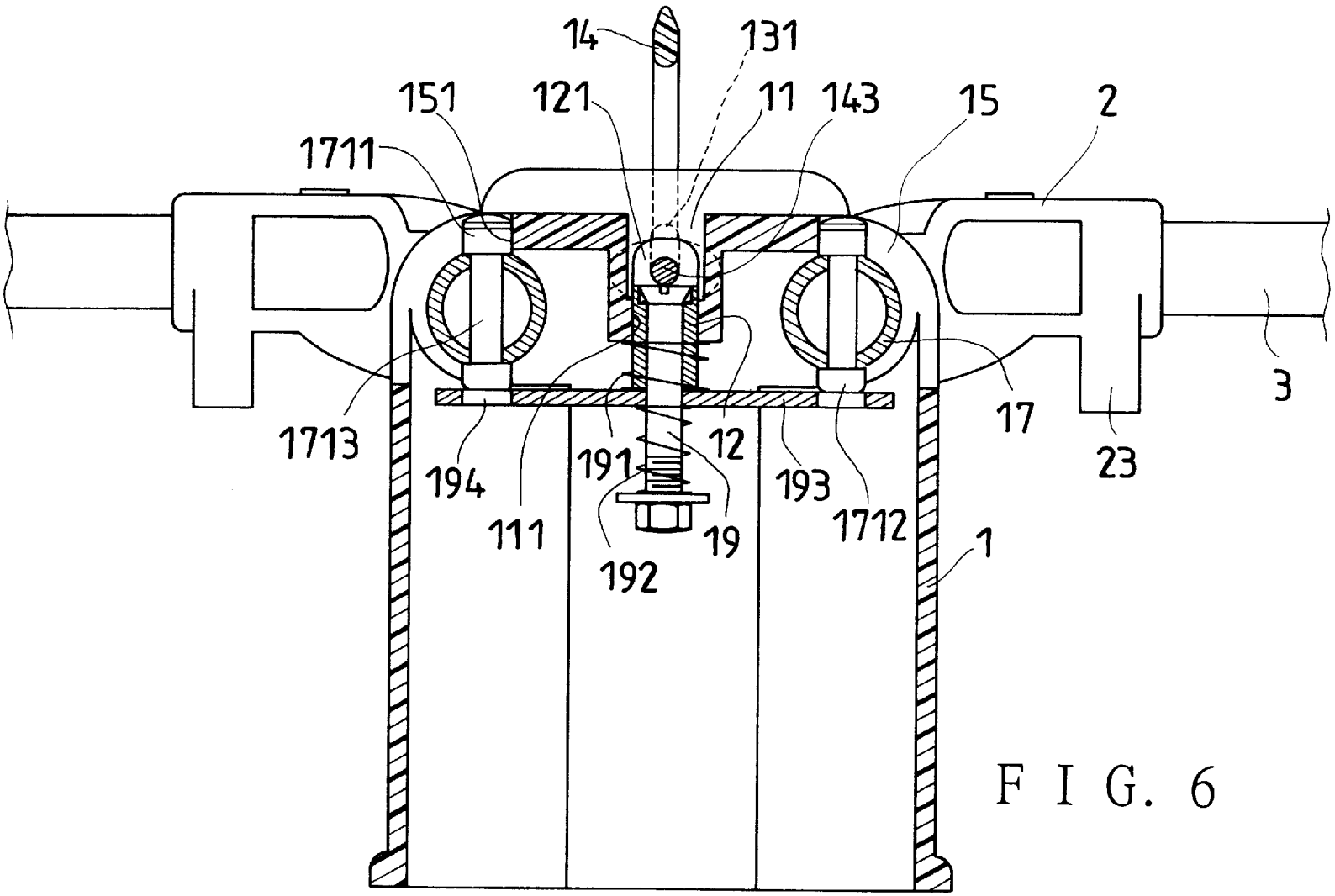
FIG. 6 is a cross-sectional view of the base of the present invention under a first step of folding movement.

A connecting bolt 19 is passed through the tube-shaped element 12 from the threaded rod part, and is passed through an upper spring 191, a central hole of an engaging board 193, and a lower spring 192 in sequence; the upper spring 191, the engaging board 193, and the lower spring 192 are movably received in the main body 1; the upper spring 191 is confined between a bottom of the wall of the receiving room 11 and the engaging board 193; a washer, and a nut (not numbered) is connected to the lower end of the connecting bolt 19 to prevent the lower spring 192 from falling out. The engaging board 193 has engaging holes 194 at two end portions thereof The main body 1 has hollow 13 on central parts of two sides, and through holes 131 having elongated openings on the hollows 13; the through holes 131 are arranged such that the longer sides of the elongated openings are vertical when the main body 1 is disposed in position to support the baby bed on the ground. The controlling handle 14 has two cam parts 142 at two ends; the cam parts 142 each has a pivotal hole 141. A pivotal rod 143 is passed through the through holes 131 of the main body 1, the pivotal holes 141 of the controlling handle 14, and the holed connecting protrusions 121 of the tube-shaped element 12 with the cam parts 142 of the controlling handle 14 being turnably fitted onto a respective one of the hollows 13 of the main body 1; thus, the controlling handle 14 can be pivoted on the pivotal rod 143 between an upright position, as shown in FIG. 6, where the lower one of the longer sides of each of the cam parts 142 abuts an engaging recess 132 (FIG. 3) of the corresponding hollow 13, and a substantially laid-down position (FIG. 2) where one of the narrower sides of each of the cam parts 142 abuts the engaging recess 132 of the hollow 13.

Thus, the controlling handle 14 can be used to control a position (height) of the engaging board 193 by pivoting between the upright position and the substantially laid-down position.

The main body 1 further has confining protrusions 18 on two sides of a lower part.

The axles 17 each has a central connecting hole 172 at the middle part, and two connecting holes (not numbered) at two end portions. The axles 17 are each turnably passed through a corresponding one of the through receiving hole sets 16 of the main body 1 with the central connecting hole 172 disposed in the intermediate gap 15. The axles 17 each further has a rod-shaped engaging part 171 firmly passed through the central connecting hole 172; the rod-shaped engaging part 171 includes a rod-shaped fixing element 1713 screwed into an upper ring 1711, and a lower ring 1712 from two ends for securing the rod-shaped engaging part 171 to the axle 17.

The connecting members 2 each has a connecting room 22, a connecting hole 21 and a downward projection 23. The connecting members 2 are each connected to a respective one of the end portions of the axles 17 from the connecting hole 21 by means of rivets inserted through same, and the connecting holes of the end portions of the axles 17. Thus, the turning members 2 can be pivoted up and down with the axles 17 turning in the through receiving holes 16 for stretching and folding the baby bed.

Figure 4:
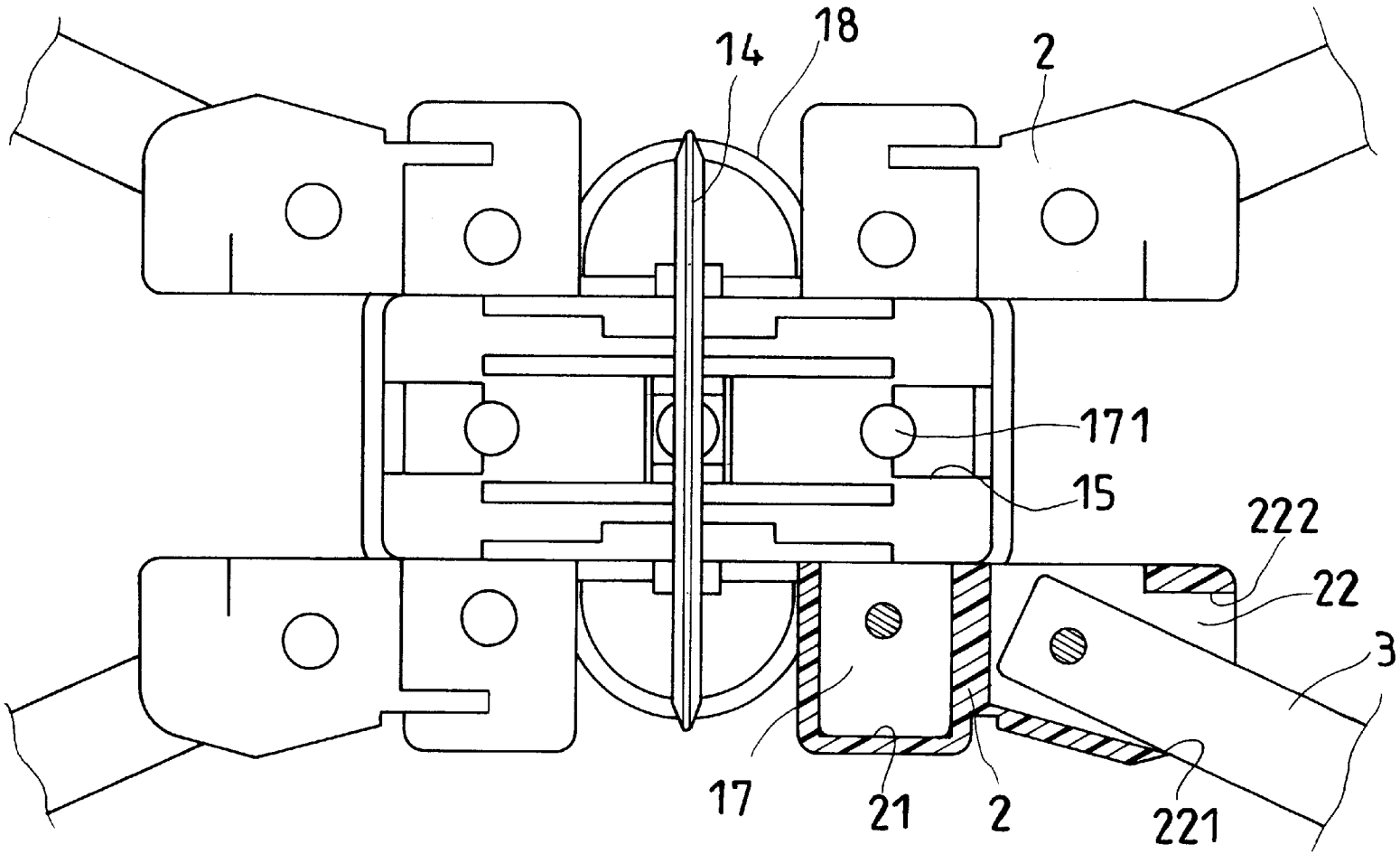
FIG. 4 is a top view of the base of the present invention.
Figure 5:
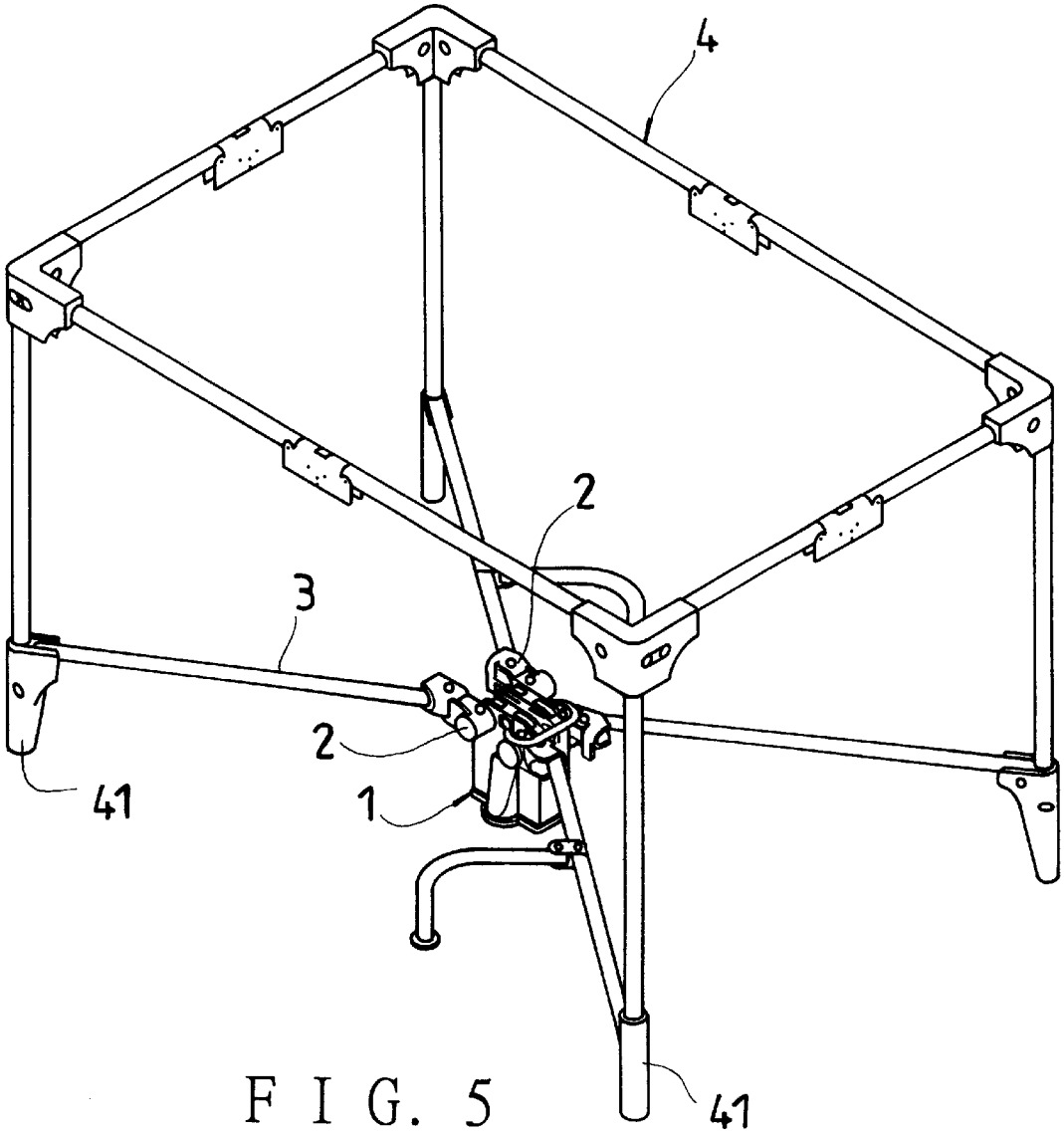
FIG. 5 is a perspective view of the frame of a foldable baby bed with the base of the present invention.
Figure 11:
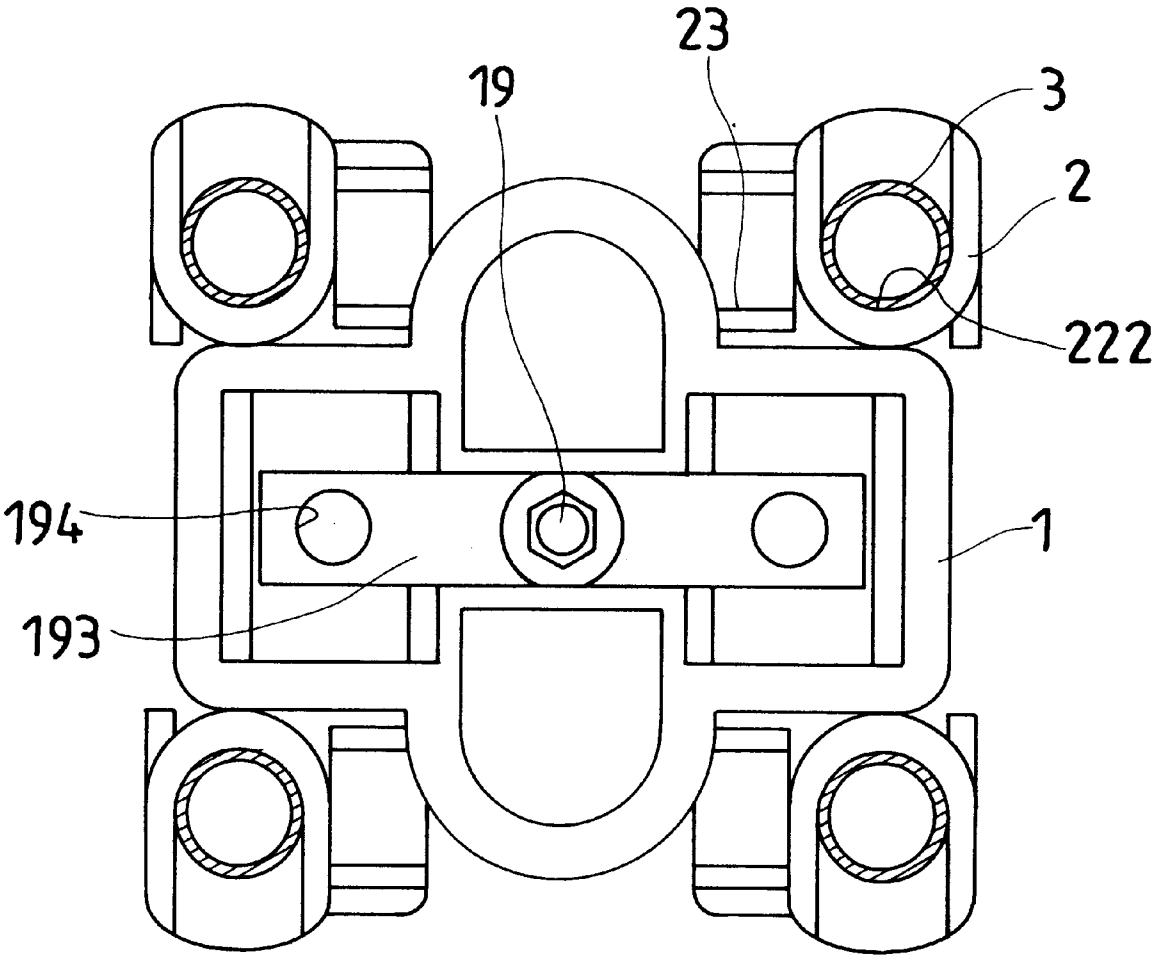
FIG. 11 is a bottom view of the base of the present invention under stretching movement.
Figure 12:
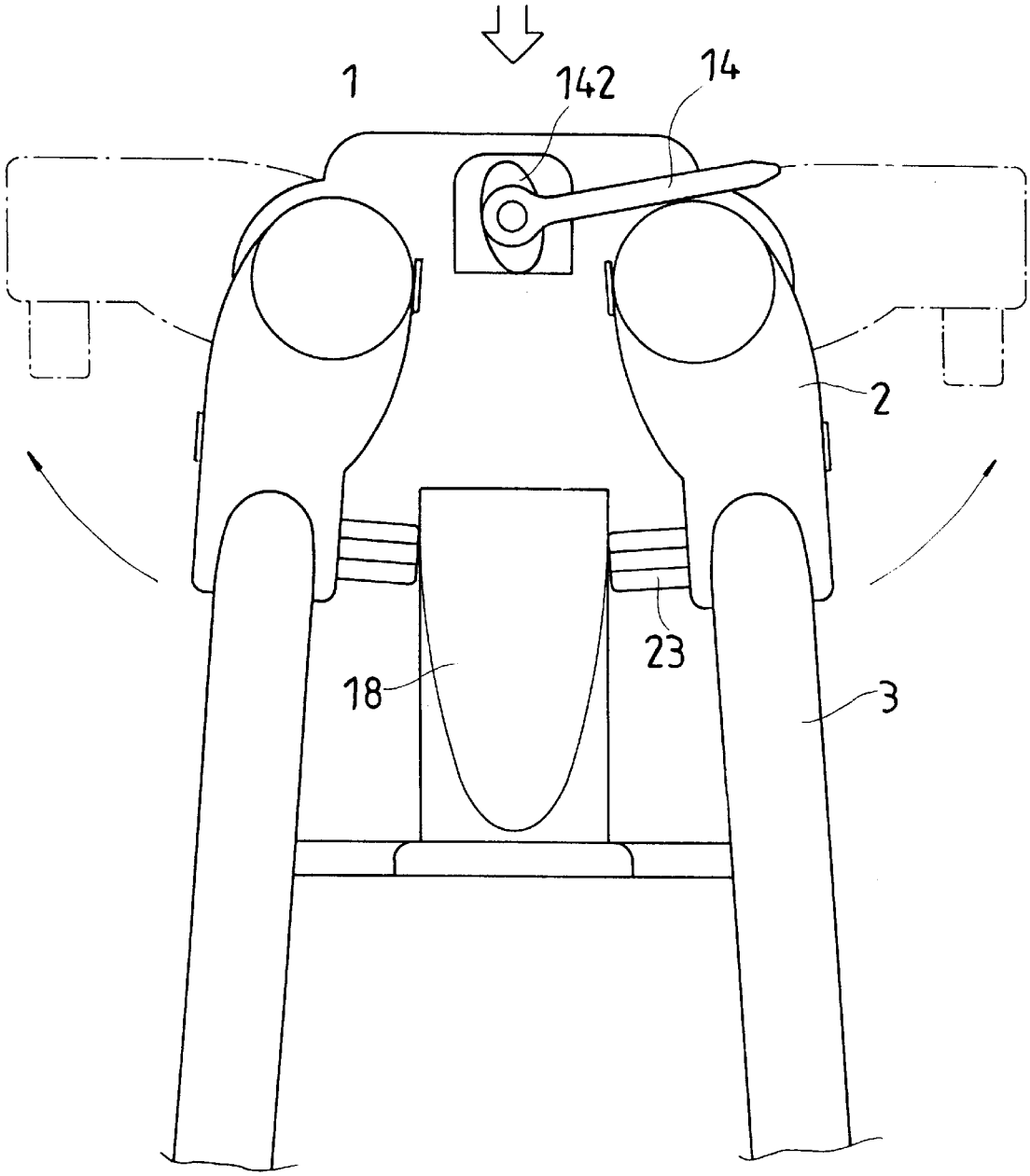
FIG. 12 is a view of the base of the present invention under stretching movement.
Figure 13:
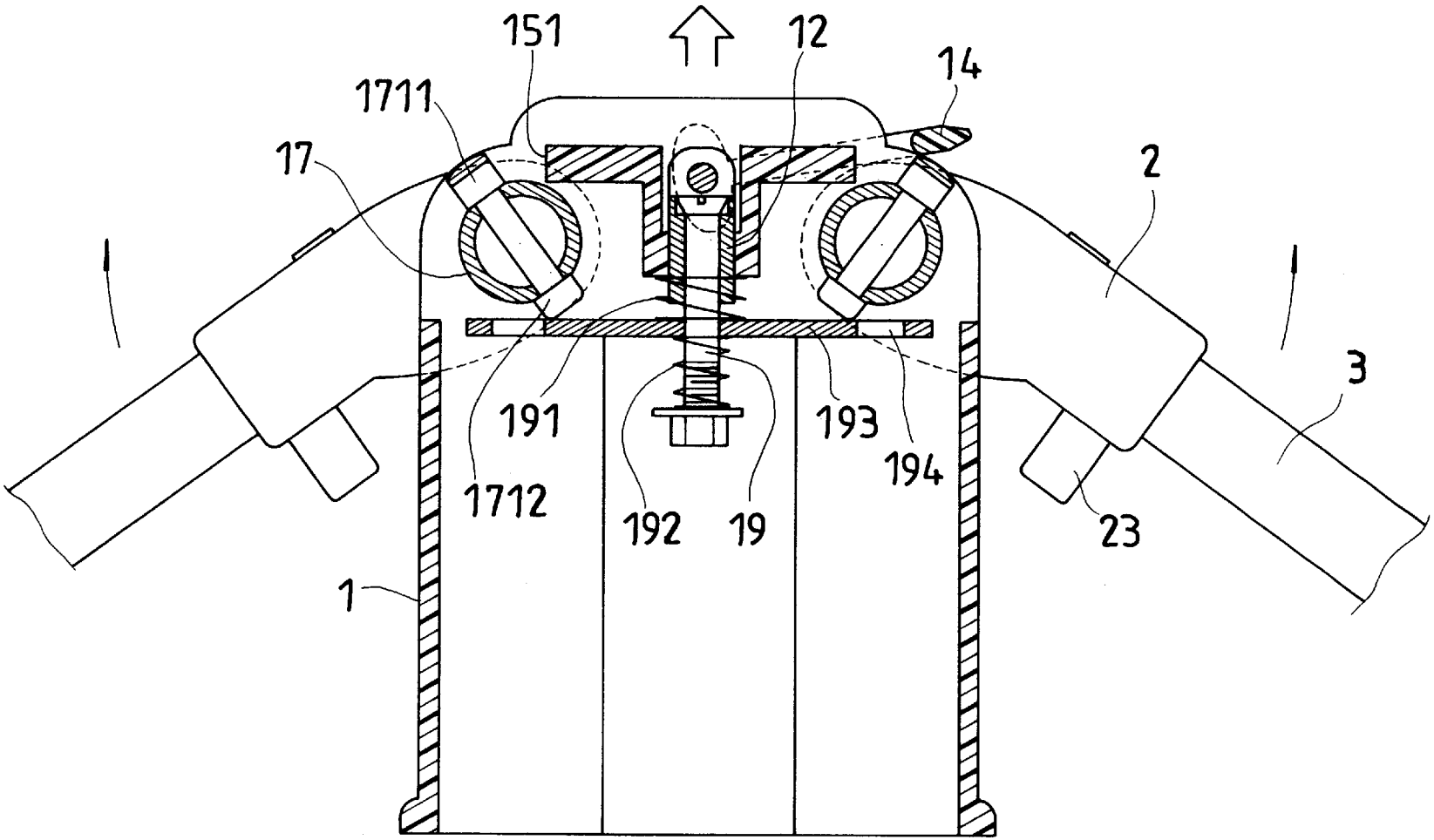
FIG. 13 is a cross-sectional view of the base of the present invention under stretching movement.
Figure 14:
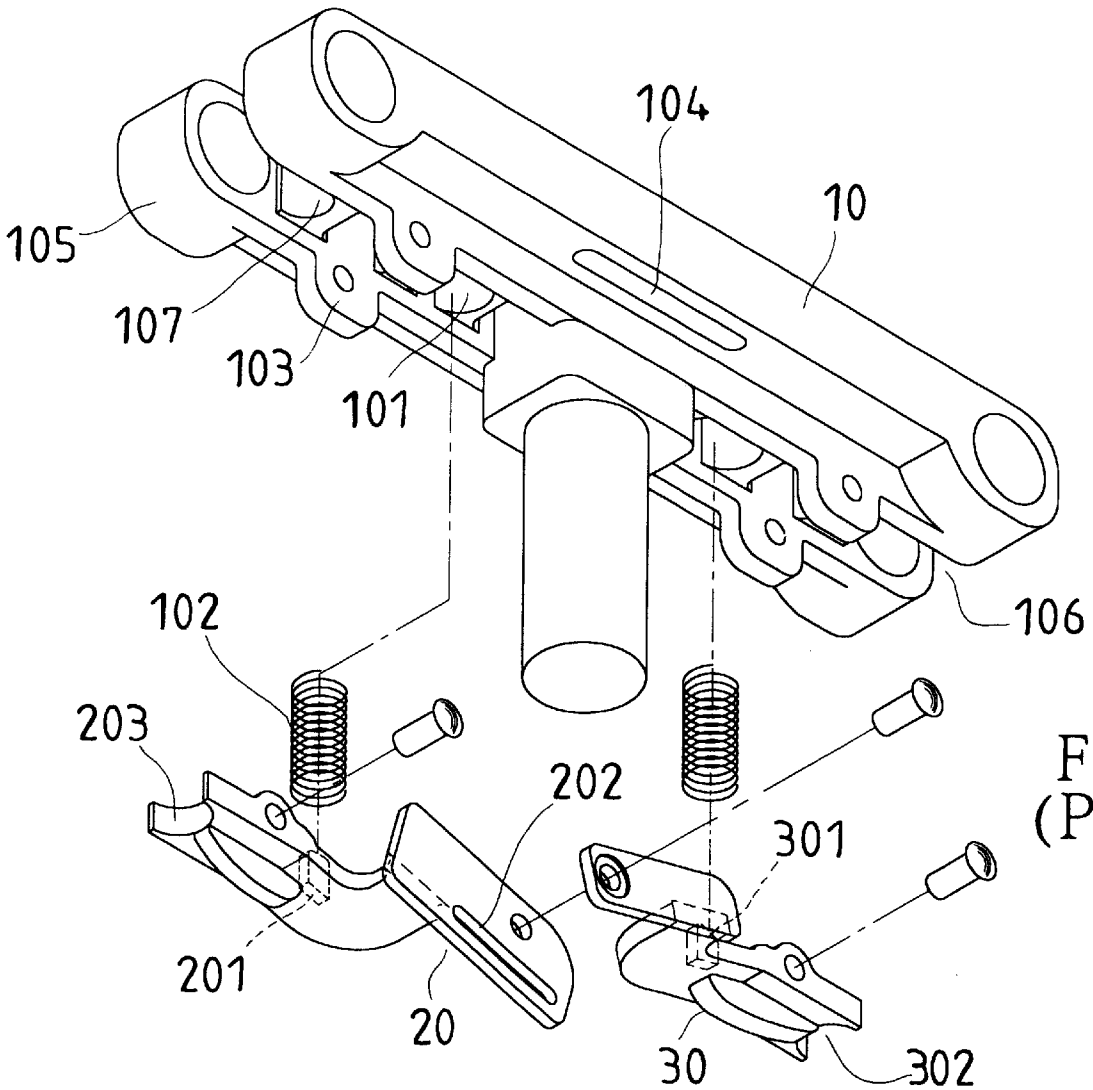
FIG. 14 (PRIOR ART)
FIG. 14 is an exploded perspective view of the conventional base of a foldable baby bed in the Background.
Figure 15:
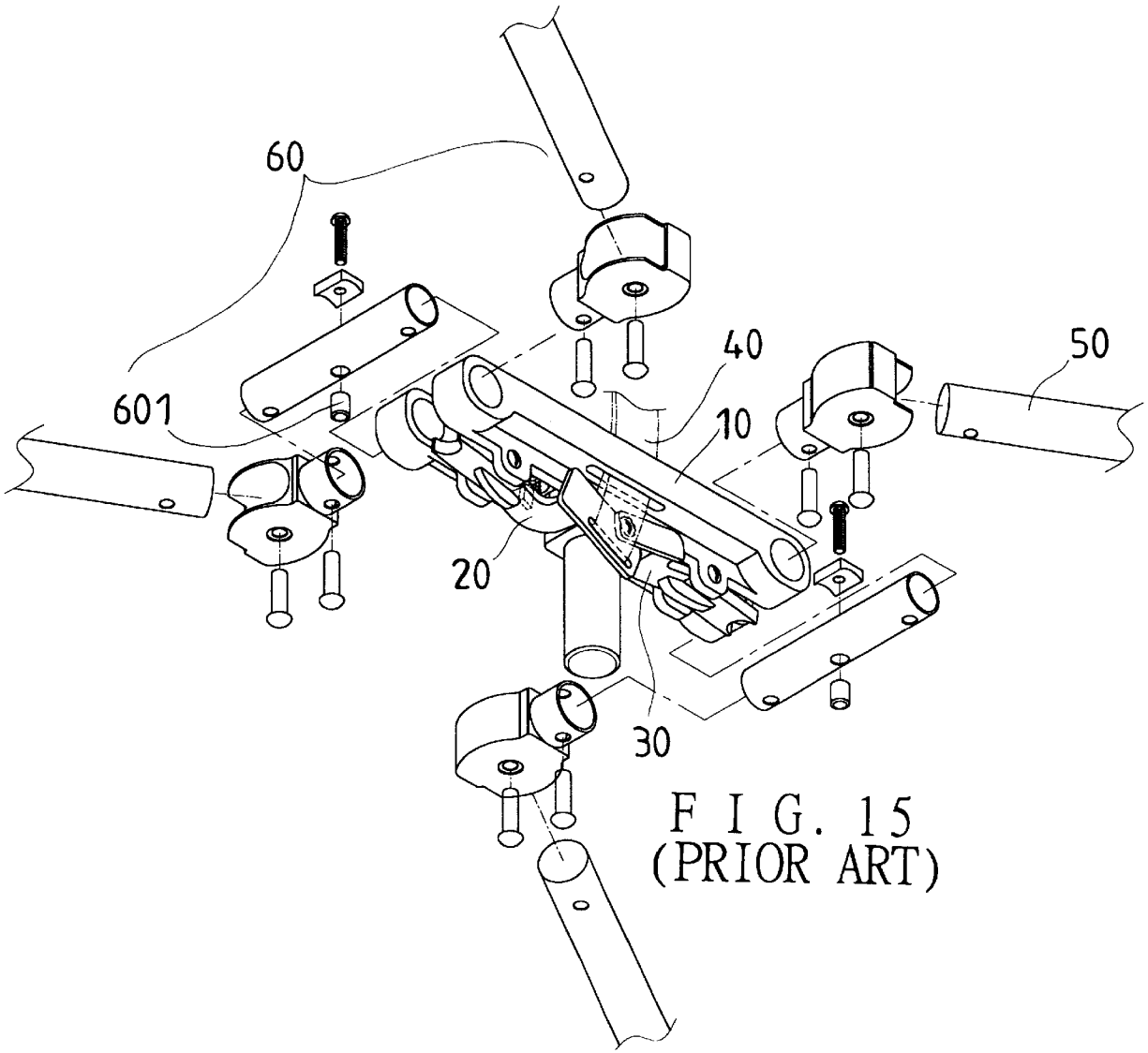
FIG. 15 (PRIOR ART)
FIG. 15 is a fragmentary exploded perspective view of the conventional base of a foldable baby bed in the Background.

The connecting rods 3 (FIGS. 3 and 4) are pivoted to a respective one of the connecting rooms 22 of the connecting members 2 from inner ends, and are pivoted to the frame of the baby bed, which is not the subject of the present invention, and not detailed here. Referring to FIGS. 4 and 11, the connecting rooms 22 each has confining portions 221 (FIG. 4) and 222 (FIG. 11); the confining portion 221 is provided for stopping the connecting rod 3 from pivoting further outwards when the baby bed is stretched to an in-use position; the confining portion 222 is provided for stopping the connecting rod 3 from pivoting further inwardly of the main body 1 when the baby bed is folded to a not-in-use position.

Moreover, when the connecting members 2 are pivoted inwardly of the main body 1 to fold the baby bed, the projections 23 of the connecting members 2 will contact the confining protrusions 18 of the main body 1 for stopping the connecting members 2 in a desired positions where the folded body bed can stand on the ground.

When the baby bed is stretched to an in-use position, referring to FIG. 2, the controlling handle 14 is moved to the laid-down position for one of the narrower sides of each of the cam parts 142 to abut the engaging recess 132 (FIG. 3) of the main body 1; thus, the pivotal rod 143 is lifted to a top edges of the through holes 131 having elongated openings for moving the tube-shaped element 12, and the engaging board 193 upwards to a locking position where the engaging holes 194 of the engaging board 193 fit onto the lower rings 1712 of the axles 17 to prevent the axles 17 from turning the upper rings 1711 of the axles 17 abut the curved walls 151 of the intermediate gaps 15 of the main body 1 to prevent the axles 17 from turning in the other direction. Therefore, the axles 17 of the base are not able to turn, making the baby bed stay in the stretched position.

Figure 7:
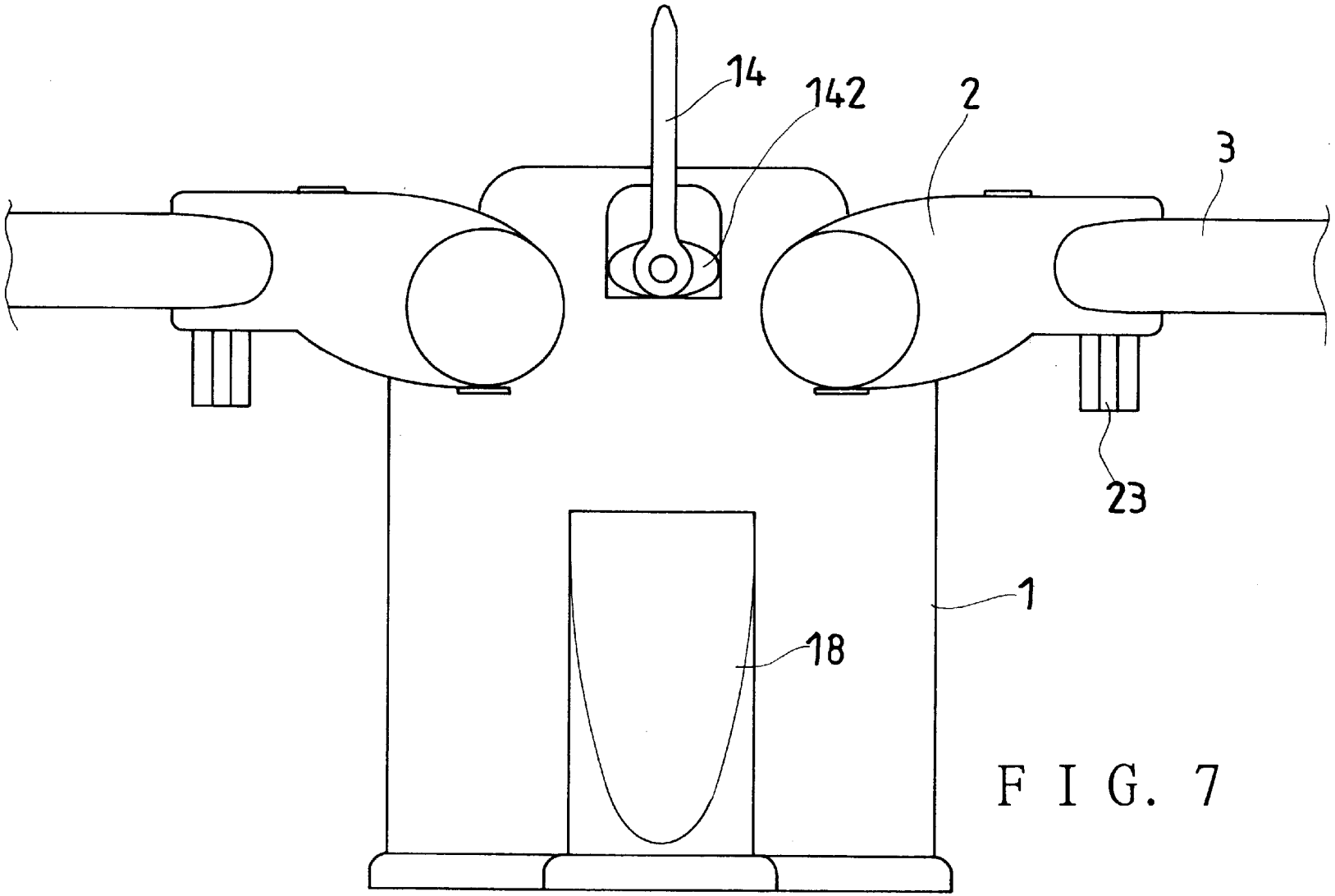
FIG. 7 is a view of the base of the present invention under the first step of folding movement.
Figure 8:
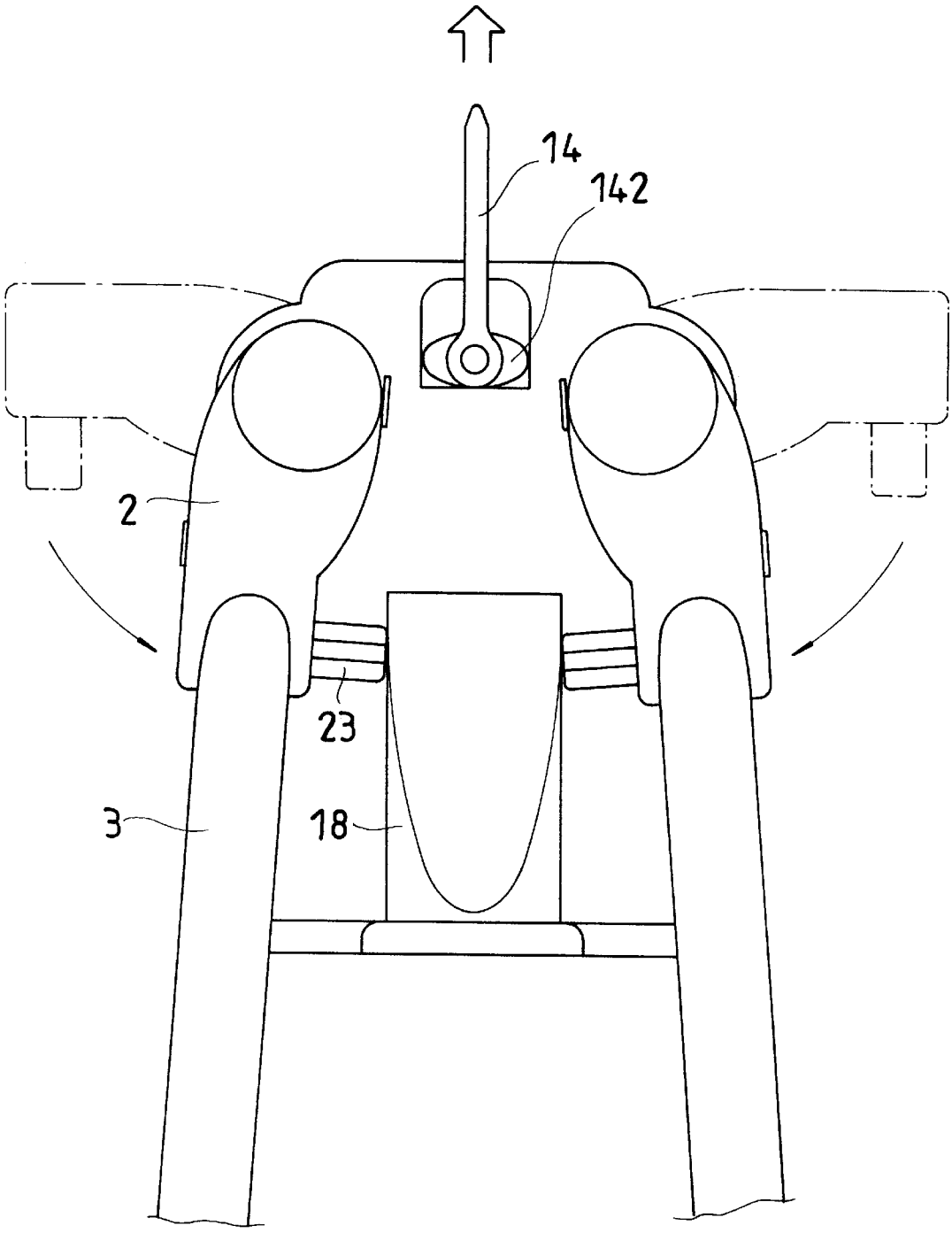
FIG. 8 is a view of the base of the present invention under a second step of folding movement.
Figure 9:
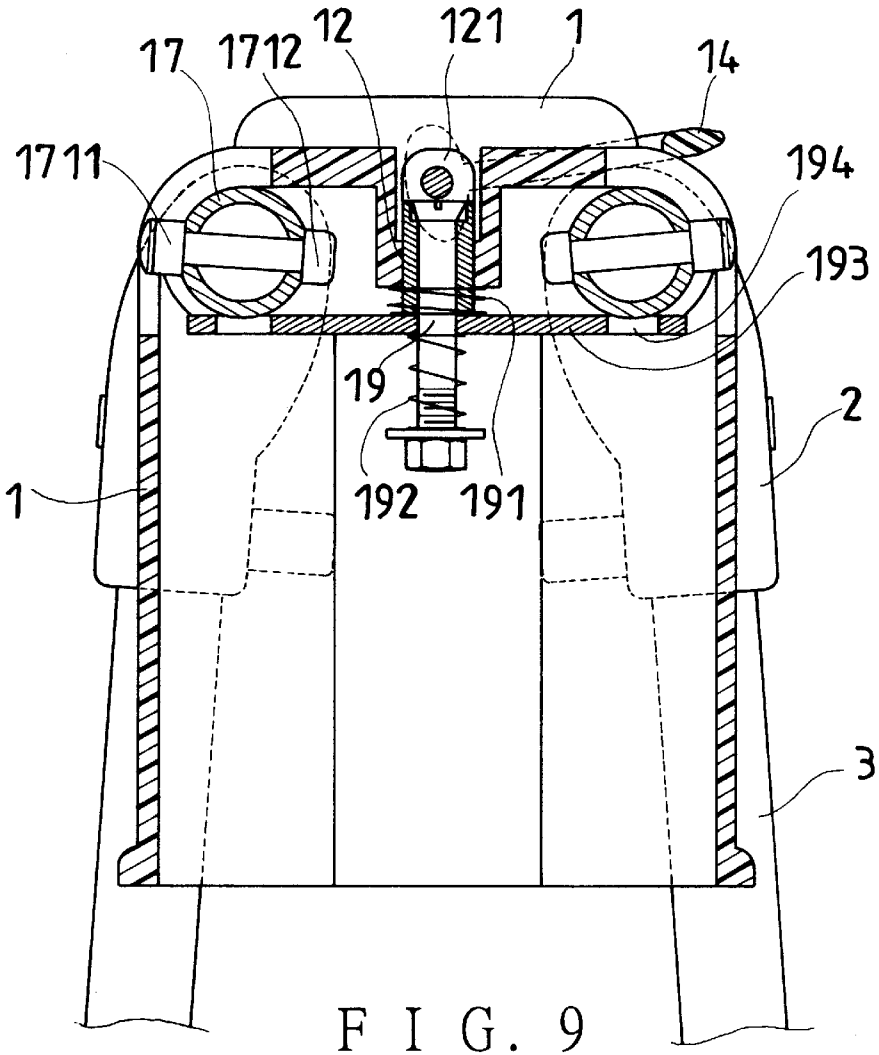
FIG. 9 is a cross-sectional view of the base of the present invention at the folded position.
Figure 10:
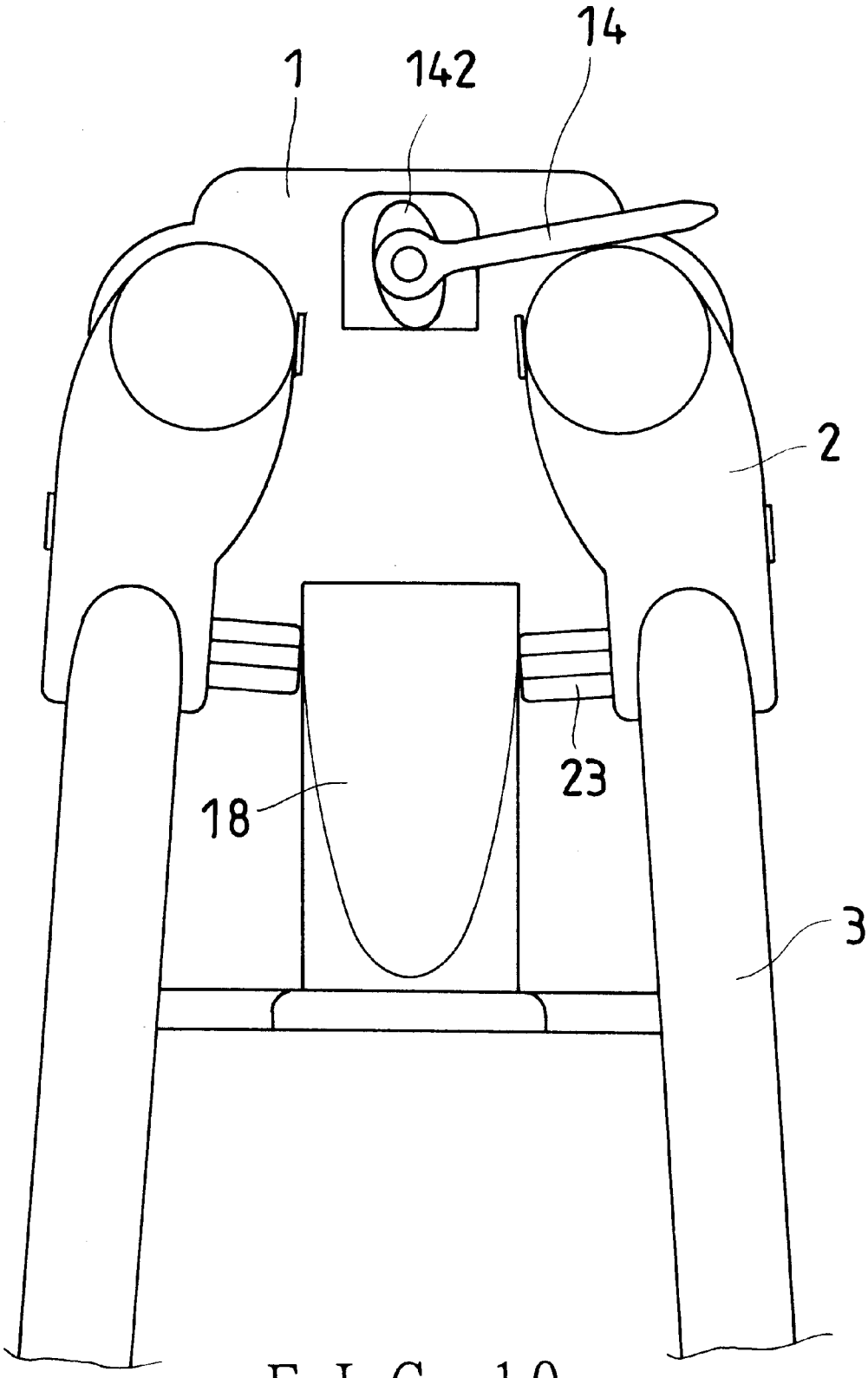
FIG. 10 is a view of the base of the present invention at the folded position.

To fold the stretched baby bed into the not-in-use position for storage, referring to FIGS. 6, 7 and 8, the controlling handle 14 is pivoted to the upright position for the lower one of the longer sides of each of the cam parts 142 to abut the corresponding engaging recess 132 such that the pivotal rod 143 moves down along the through holes 131 of the main body 1 for moving the tube-shaped element 12 and the engaging board 193 to the not-locking position where the engaging holes 194 of the engaging board 193 separate from the lower rings 1712 of the axles 17; thus, the axles 17 can turn in the through receiving holes 16 of the main body 1; then, the controlling handle 14 is lifted by the user for pivoting the connecting members 2 and the connecting rods 3 downwards to fold the baby bed into the not-in-use position. After the baby bed is folded, the controlling handle 14 is moved to the laid-down position again, and, the projections 23 of the connecting members 2 abut the edges of the confining protrusions 18 of the main body 1 for locating the connecting rods 3 at an upright position capable of supporting the folded baby bed on the ground.

To stretch the folded baby bed, the controlling handle 14 is pivoted to the upright position for the engaging holes 194 of the engaging boards 193 to separate from the lower rings 1712 of the axles 17. Then, the main body 1 is pressed to move downwards for the axles 17 to turn the connecting members 2 and the connecting rods 3 to pivot outwardly of the main body 1 until the upper rings 1711 of the axles 17 abut the curved walls 151 of the main body 1. Then, the controlling handle 14 is pivoted to the laid-down position for the engaging holes 194 of the engaging boards 193 to engage the lower rings 1712 again.

If the user wants to stretch the folded baby bed with the controlling handle 14 still staying at the laid-down position, he or she can depress the main body 1 directly; the axles 17 will turn due to the downward movement of the main body 1, and the lower rings 1712 of the axles 17 will force the engaging board 193 to move down due to the turning movement of the axles 17. When the axles 17 are turned to a position where the lower rings 1712 face the engaging holes 194, the lower springs 192 will bias the engaging board 193 upwards for the engaging holes 194 to engage the lower rings 1712 again.

From the above description, the base of a foldable baby bed according to the present invention can be known to have desirable features as follows:

1. The user can move the engaging board up and down to lock and unlock the axles respectively by simply pivoting the controlling handle on the pivotal rod 143 between the laid-down position and the upright position so the operation is relatively easy and effortless.
2. When the baby bed is stretched to the in-use position, the curved walls of the intermediate gaps of the main body can stop the upper rings 1711 of the axles 17 from moving further for permitting the connecting rods 3 to be located at a desired horizontal position.
3. With the projections 23 of the connecting members 2, and the confining protrusions 18 of the main body 1, the connecting rods 3 can be located at an upright position to support the baby bed stably when the baby bed is folded.
4. The folded baby bed can be stretched without having to first move the controlling handle to the upright position; the main body is depressed to pivot the connecting rods outwardly of the main body, making the axles turn for the lower rings of the axles to depress the engaging board biased upwards by the lower spring. When the lower rings face the engaging holes, the engaging board is moved up to engage the lower rings from the engaging holes by the lower spring. Thus, the baby bed is stretched.
5. The confining protrusions on two sides of the main body can help the main body to stand stably.
6. The main body is relatively compact and solid when compared with the middle member of the conventional base in the Background.
7. The main body has smaller transverse cross-section area than middle member of the conventional base, therefore the baby bed of the present invention can be folded into an even smaller size than the conventional one for further reducing the cost of storage and transportation.

What is claimed is:

1. A base of a foldable baby bed, comprising (a) a main body having a receiving room having a tube-shaped element up and down movably passed therethrough; said main body receiving a movable engaging board therein with a connecting bolt being passed through said engaging board; said connecting bolt being connected to said tube-shaped element from an upper end, and passed through an upper spring disposed between a lower end of said receiving room and an upper side of said engaging board; said connecting bolt being passed through a lower spring disposed between said board and a nut connected to a lower end of said bolt for permitting said engaging board to move together with said tube-shaped element;

(b) two axles each turnably passed through a pair of through receiving holes of said main body; said axles each having a rod-shaped engaging part having two end portions sticking out from a middle part of said axles; said main body having intermediate gaps between said through receiving holes for said rod-shaped engaging parts to be movably received therein;

(c) four connecting members connected to a respective one of end portions of said axles sticking out from said through receiving holes; said connecting members each having a connecting room pivotally connected to a corresponding connecting rod pivoted to a frame of said baby bed;

(d) a controlling handle having two holed cam parts at two ends; said controlling handle being pivotably connected to said main body by means of a pivotal rod passed through said cam parts, a through hole of said main body, and an upper end portion of said tube-shaped element; said cam parts being fitted onto a respective one of hollows on two sides of said main body; said through hole of said main body having an elongated opening for permitting said controlling handle to be pivoted on said pivotal rod to move said engaging board up and down together with said pivotal rod, and said tube-shaped element; whereby said engaging board is moved down by means of said handle to an unlocking position where engaging holes on two end positions thereof separate from a corresponding one of said sticking-out end portions of said middle rod-shaped engaging part of said axles for permitting said axles to turn in said through receiving holes to pivot said connecting members and said connecting rods to fold said baby bed; said engaging board is moved up to a locking position by means of said handle for said engaging holes to engage said sticking-out end portions of said rod-shaped engaging part of said axles to fix said connecting rods at a stretched position when said baby bed is unfolded.

2. The base of a foldable baby bed as claimed in claim 1, wherein said rod-shaped engaging parts each includes a rod-shaped fixing element passed through said middle part of said axles; said fixing element being connected to a lower ring, and an upper ring from two end portions respectively.

3. The base of a foldable body bed as claimed in claim 1, wherein said connecting members each having a first confining portion, and a second confining portion in said connecting room for stopping said connecting rod from pivoting further outwards under a stretched position of said baby bed, and for stopping said connecting rod from pivoting further inwardly of said main body under a folded position of said baby bed respectively.

4. The base of a foldable body bed as claimed in claim 1, wherein said main body has confining protrusions on two sides for contacting a projection of each of said connecting members to locate said connecting members in folding said baby bed.

5. The base of a foldable body bed as claimed in claim 1. wherein said main body has engaging recesses on lower edges of said hollows locating said cam parts of said controlling handle in position.

6. The base of a foldable body bed as claimed in claim 1, wherein said main body has curved walls on upper parts of said intermediate gaps for stopping upper ones of said sticking-out end portions of said rod-shaped engaging part of said axles from moving further into said main body.

* * * * *